US011253891B2

(12) United States Patent
Benjamins

(10) Patent No.: US 11,253,891 B2
(45) Date of Patent: Feb. 22, 2022

(54) SEPARATING SCREEN CONVEYOR

(71) Applicant: Bollegraaf Patents and Brands B.V., Appingedam (NL)

(72) Inventor: Jan Benjamins, Elim (NL)

(73) Assignee: Bollegraaf Patents and Brands B.V., Appingedam (NL)

( * ) Notice: Subject to any disclaimer, the term of this patent is extended or adjusted under 35 U.S.C. 154(b) by 0 days.

(21) Appl. No.: 17/062,759

(22) Filed: Oct. 5, 2020

(65) Prior Publication Data

US 2021/0107032 A1 Apr. 15, 2021

(30) Foreign Application Priority Data

Oct. 10, 2019 (NL) ..... 2023991

(51) Int. Cl.
*B07B 1/15* (2006.01)
*B07B 1/46* (2006.01)

(52) U.S. Cl.
CPC ..... *B07B 1/15* (2013.01); *B07B 1/4627* (2013.01)

(58) Field of Classification Search
CPC ..... B07B 1/15; B07B 1/4627; B07B 1/155
See application file for complete search history.

(56) References Cited

U.S. PATENT DOCUMENTS 4,538,734 A 9/1985 Gill
5,975,441 A * 11/1999 Burkholder ..... B07B 1/155 241/101.76
8,424,684 B2 * 4/2013 Campbell ..... B07B 1/14 209/671
8,522,983 B2 * 9/2013 Davis ..... F16D 1/0864 209/672
8,827,083 B2 * 9/2014 Doppstadt ..... B07B 1/50 209/672
10,259,011 B2 * 4/2019 Klaassen ..... B07B 1/155
2007/0138068 A1 * 6/2007 Davis ..... B07B 1/155 209/672

(Continued)

FOREIGN PATENT DOCUMENTS

CN 203965283 U 11/2014
CN 104826794 A 8/2015

(Continued)

OTHER PUBLICATIONS

Search report and Written Opinion issued in corresponding application No. NL2023991 dated Jul. 15, 2020, 13 pages.

*Primary Examiner* — Patrick H Mackey
(74) *Attorney, Agent, or Firm* — Pearne & Gordon LLP

(57) ABSTRACT

A separating screen conveyor for sorting a material into fractions having different distributions of a property of the particles or items. The conveyor screen has a row of shafts mutually spaced in a conveying direction, each shaft carrying a row of axially spaced discs for intermittently urging material on the sorting conveyor upward and in the conveying direction. The discs are releasably clamped to the shafts which have strips oriented in longitudinal direction of the shafts on circumferential surfaces of the shafts. The strips have toothed surfaces. Openings of the discs each have a recess closely fitting to the strips and teeth in engagement with the teeth of the toothed surfaces of the strips. The pitch of the teeth of the strips is smaller than the maximum widths of the discs in the longitudinal direction of the shaft.

8 Claims, 6 Drawing Sheets

(56) References Cited

U.S. PATENT DOCUMENTS

| | | | | |
|---|---|---|---|---|
| 2010/0264069 | A1* | 10/2010 | Green | B07B 1/15 209/262 |
| 2021/0069752 | A1* | 3/2021 | Burdzy | B07B 1/155 |

FOREIGN PATENT DOCUMENTS

| | | | | |
|---|---|---|---|---|
| DE | 1950038 | A1 | 11/1966 | |
| DE | 102015112027 | A1 | 1/2017 | |
| EP | 2322288 | A2 | 5/2011 | |
| EP | 3263229 | A1 | 1/2018 | |
| GB | 2273143 | A | 6/1994 | |
| WO | 9420227 | A1 | 9/1994 | |
| WO | WO-9420227 | A1 * | 9/1994 | B07B 1/15 |
| WO | 9709129 | A1 | 3/1997 | |
| WO | WO-9709129 | A1 * | 3/1997 | B07B 1/15 |

* cited by examiner

SEPARATING SCREEN CONVEYOR

FIELD AND BACKGROUND OF THE INVENTION

The invention relates to a separating screen conveyor according to the introductory portion of claim 1.

Separating screen conveyors or sorting screen conveyors are used for separating materials composed of large numbers of particles or items into fractions with different distributions of a property. The item property on which separation is based may for instance be size of the particles or items, such as in separating mud from potatoes, separating larger stones from smaller stones, sand and clay or separating larger fruit from smaller fruit. The separation may also be based on other properties, such as separating on the basis of stiffness of the items, such as in separating waste paper from waste cardboard to avoid inclusion of substantial amounts of waste cardboard in raw material from which paper is to be made, which would result in relatively grey or brown paper.

In such a separating conveyor, a screen is formed by a row of rotatable, driven shaft assemblies mutually spaced in a conveying direction and each extending transversely to the conveying direction. The shafts of each of the shaft assemblies each carry a row of radially extending discs for intermittently urging material on the separating screen conveyor upward and in the conveying direction. The discs of each of the rows are mutually spaced in longitudinal direction of the respective shaft. In particular for sorting on the basis of deformability or for removing adhering material from larger items, rotary contours of discs carried by each of the shafts may project between rotary contours of the discs carried by a neighboring one of the shafts. In particular for accurate separation by size of generally ball, cube or similarly shaped items with no predominant length and/or width, discs of successive shafts may be positioned mutually in-line in transport direction, leaving open passages for material to fall through that precisely match the maximum dimensions of items that are to fall through the passages.

In operation, a material to be separated is fed to the upstream end of the separating conveyor. Rotary motion of the discs intermittently urges the material on the conveyor upward and forward in conveying direction. Thus, the material on the conveyor is simultaneously shaken and transported along the conveyor. The smaller and/or more easily deformable parts of the material tend to fall through openings between the shafts and the discs. Since for instance paper in a mixture of paper and cardboard is typically of a smaller size and more flexible than cardboard, paper on the conveyor tends to fall through interspaces between the shafts and the discs, while cardboard tends to remain on top of the conveyor. Thus, a first separated material predominantly consisting of cardboard can be collected at the downstream end of the conveyor or succession of conveyors, and a second separated material predominantly consisting of paper can be collected from under the conveyor.

A separating screen conveyor of the initially-identified type is described in applicant's European patent 3 263 229. In this separating screen conveyor, the discs of at least one of the rows in longitudinal direction of the respective shaft each have at least one anchoring member arranged for fixation in a recess in an outside surface of the shaft and at least one tensioner for tensioning the disc body and the anchoring member radially towards each other. The shaft to which these discs are clamped has a recess in its outside surface. The recess may be a slot extending in longitudinal direction of the shaft, wherein side walls of the slot have at least one undercut in a side wall of the slot and the anchoring member has a projection anchoring in the undercut.

Chinese patent application 104 826 794 discloses a roller screen with shafts on which annular hobbing members held mutually spaced in axial direction by spacer sleeves. The hobbing members are mounted over the shaft and engaged against rotation about the shaft by pin keys extending axially through pin key holes in and internal surface of the hobbing members.

European patent application 2 322 288 discloses a material processing screen with a row of shafts, the row extending in a transport direction and the shafts extending horizontally and perpendicularly to a transport direction. Discs are mounted to the shafts and positioned by means of pins projecting into bores in a circumferential surface of the shaft.

U.S. Pat. No. 4,538,734 discloses a disk screen apparatus with shafts perpendicular to a transport direction over the screen. The shafts are equipped with a plurality of strips. Each of the strips has in its edge a series of longitudinally spaced circumferentially extending indexing and keying notches which extend inwardly from the edge. Each of the disks has in its inner diameter edge clearance recesses of a depth and width equal to the thickness and width of the strips plus clearances so as to closely slidably receive the strips for longitudinal mounting of the disks successively onto the shaft starting at either end and working towards the opposite end. After a disk has reached its axial position, the disk is turned about the coaxial axes of the disk and the shaft so that an inner edge shoulder portion of the disk at the side of the notch enters the notch and is engaged thereby. After all the disks of a shaft have been positioned axially and turned, a locking bar is slid into place through gaps remaining between recesses and the strip on a side opposite to the side where the notches are located.

SUMMARY OF THE INVENTION

It is an object of the present invention to provide a simple, low cost solution that allows the discs to be mounted and dismounted quickly yet accurately and allows the discs to be mounted in a large number of axial positions.

According to the invention, this object is achieved by providing a separating screen conveyor according to claim 1. Because the teeth of the toothed surface of the strip and the teeth of the disc are in engagement and the pitch of the teeth of the strip is smaller than the maximum width of each of the discs in the longitudinal direction of the shaft, a fine adjustability of the axial position of the discs is allowed, but also distinct predetermined mounting positions are provided, which facilitates mounting the discs accurately with mutually identical axial spacings between all discs on the shaft. The toothed surface provided on a strip projecting radially from the shaft can be manufactured in an efficient way, because no shaping process has to be performed on the shaft as a whole.

Particular elaborations and embodiments of the invention are set forth in the dependent claims.

Further features, effects and details of the invention appear from the detailed description and the drawings.

DETAILED DESCRIPTION

Figure 1:
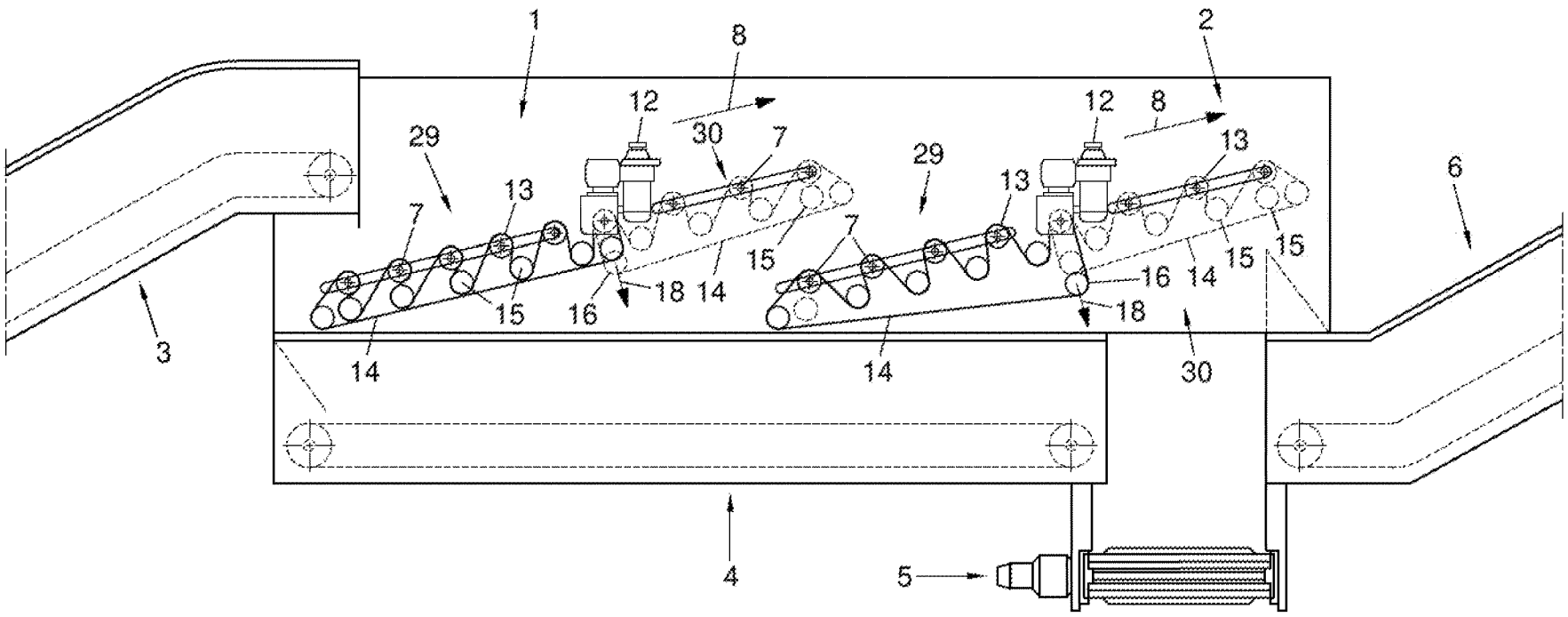
FIG. 1 is a schematic side view of an example of a separating conveyor system according to the present invention.

In FIG. 1, an example of a separating conveyor system is shown of which a separating portion is composed of two separating conveyor screens 1, 2 according to the invention. The conveyor screens 1, 2 are arranged in series. Depending on separating requirements and properties of the materials to be separated, a single separating screen or three or more separating screens arranged in series may also be provided. The upstream one 1 of the conveyor screens has a downstream end positioned above the upstream end of the downstream one 2 of the conveyor screens, so that material which has been passed over the upstream conveyor 1 is dropped onto the downstream conveyor 2. The system further includes a feeding conveyor 3 and discharge conveyors 4, 5 and 6.

Figure 2:
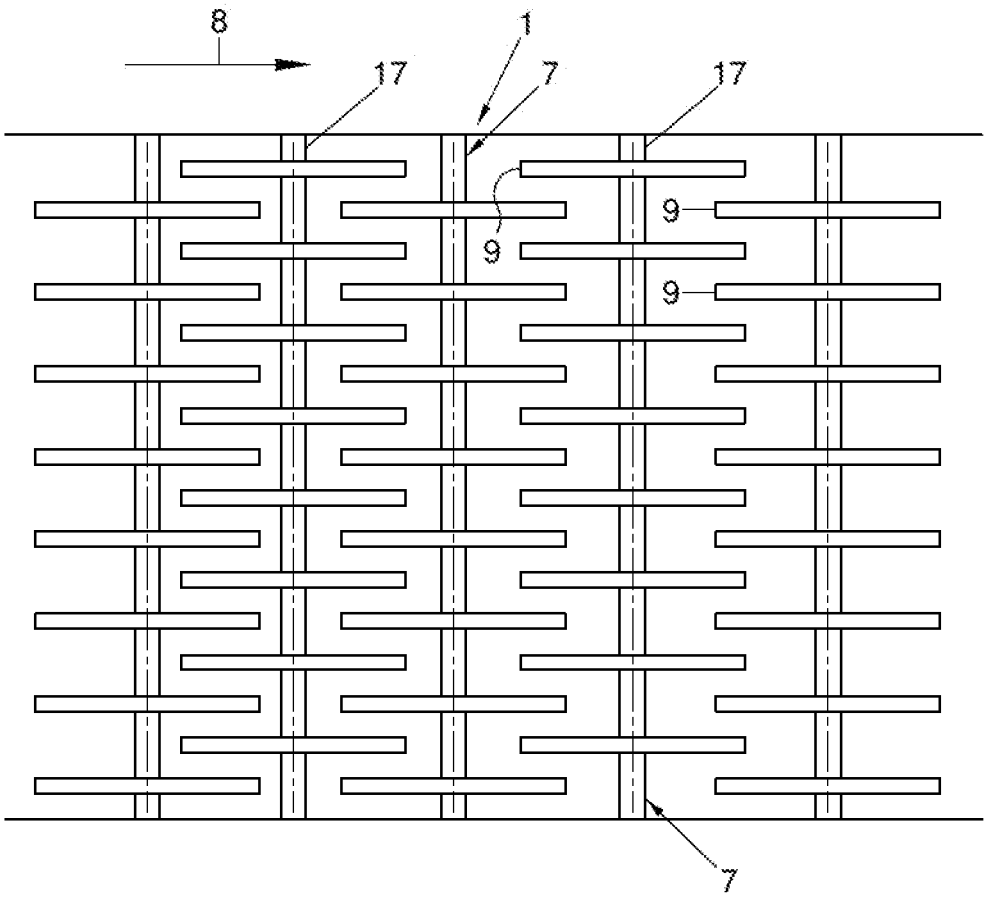
FIG. 2 is a schematic top plan view of a series of shaft assemblies of a conveyor screen of the separating conveyor system according to FIG. 1.
Figure 3:
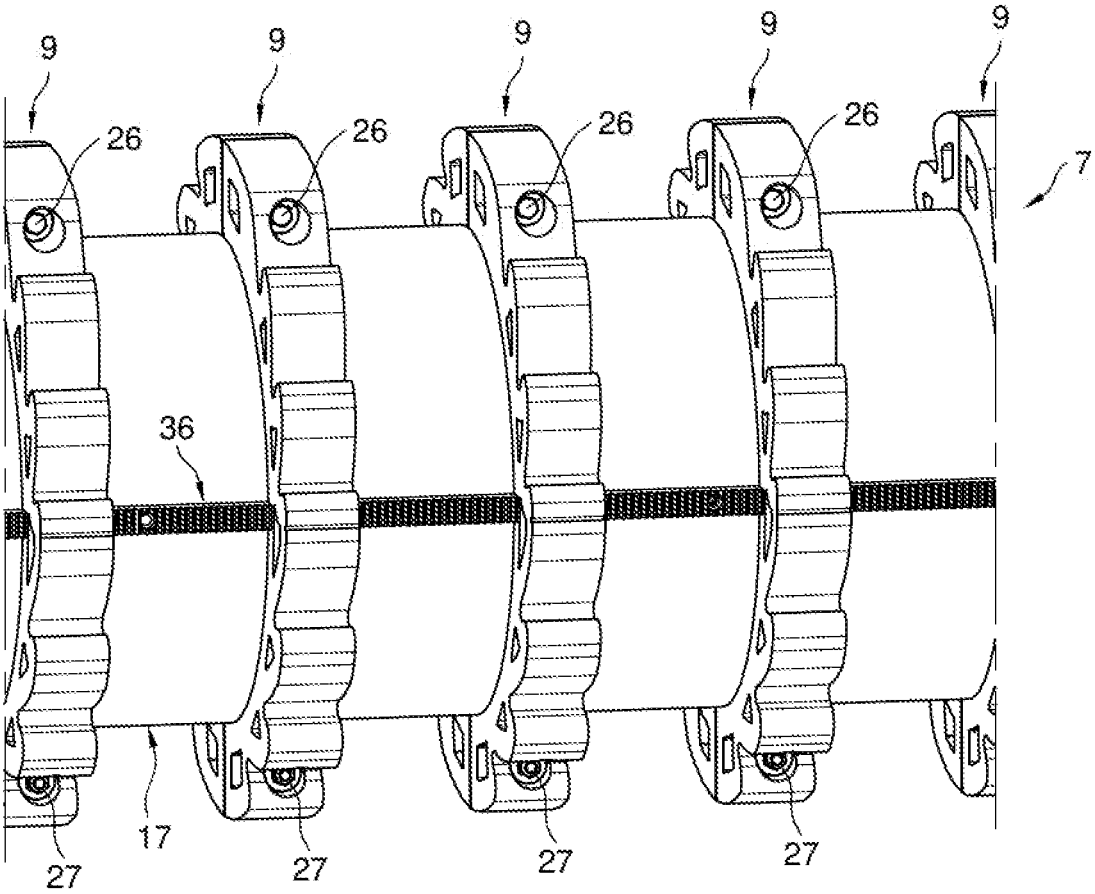
FIG. 3 is a perspective view of a portion of a shaft assembly of the separating conveyor system shown in FIGS. 1 and 2.
Figure 4:
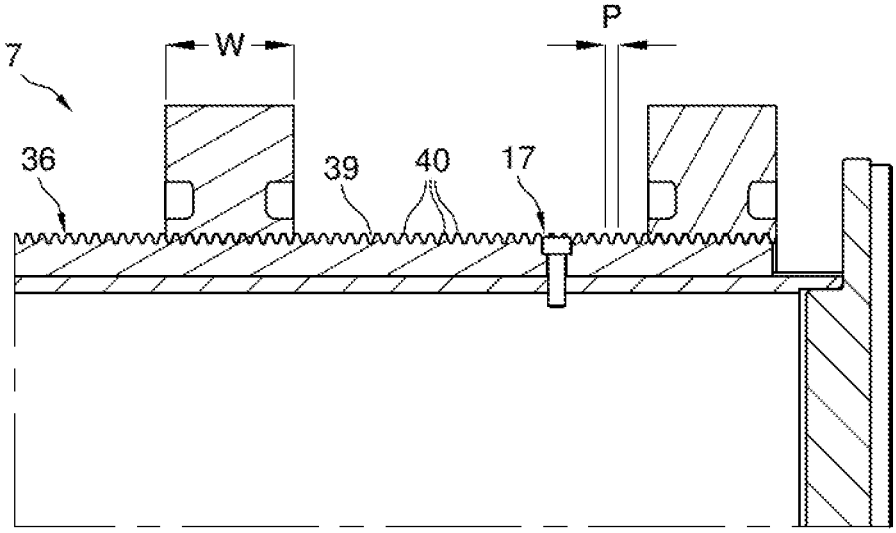
FIG. 4 is a cross-sectional view of a portion of the shaft assembly shown in FIG. 3.
Figure 5:
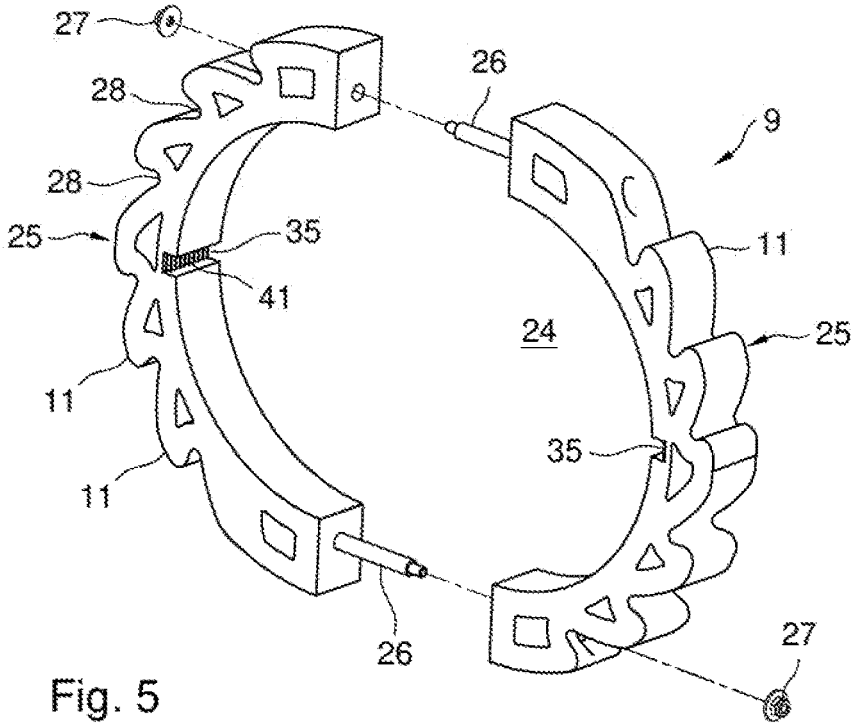
FIG. 5 is a perspective exploded view of a disc of the shaft assembly shown in FIGS. 3 and 4.
Figure 6:
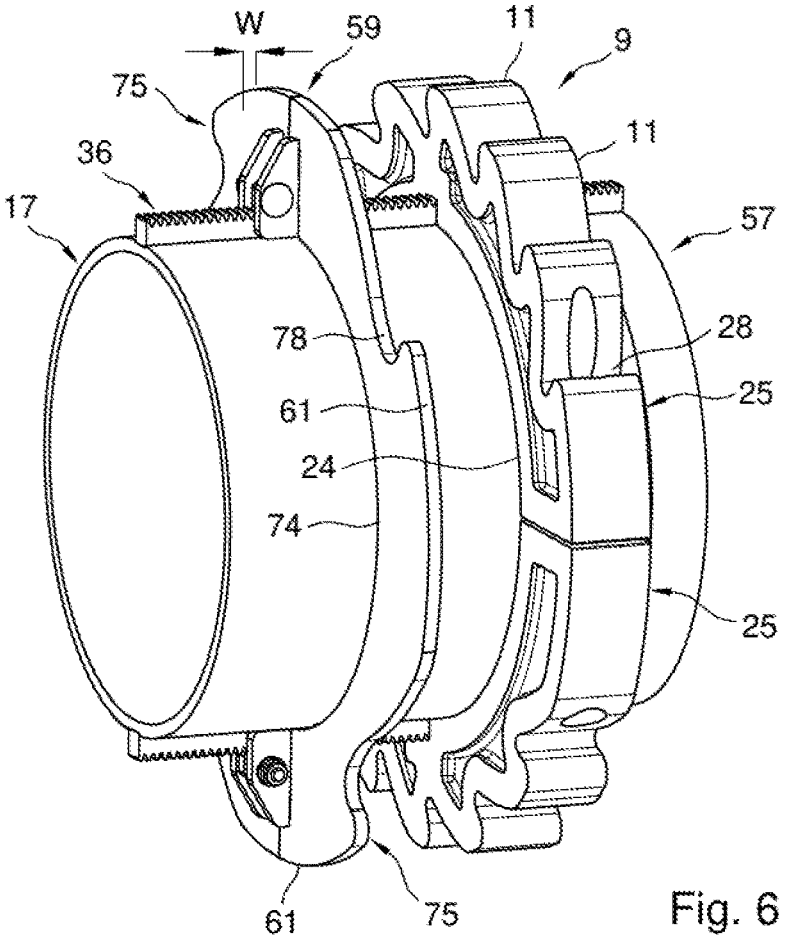
FIG. 6 is a perspective view of a cut-off portion of a shaft assembly of a second example of a separating conveyor system according to the present invention.

The conveyor screens 1, 2 are each provided with a row of rotatable, driven shaft assemblies 7 (see also FIGS. 2 and 3, in FIG. 2 not all shaft assemblies are designated by reference numerals). The shaft assemblies 7 are arranged in positions with center lines of the shaft assemblies 7 mutually spaced in a conveying direction (arrow 8) and each extend perpendicularly to the conveying direction. The shaft assemblies 7 each have a shaft 17 carrying a row of radially extending discs 9 (in FIG. 2, not all discs are designated by reference numerals) for intermittently urging material on the conveyor screen upwards and in the conveying direction 8. The discs 9 of each of the shaft assemblies 7 are mutually spaced in the longitudinal direction of the respective shaft 17. In this example, rotary contours of discs 9 (as defined by the disc portions at the largest radial distance from the shaft center line) carried by each of the shafts 17 project between rotary contours of the discs 9 carried by a neighboring one of the shafts 17. Depending on the basis for separation and the nature of the materials to be separated, other disc configurations may be provided, such as discs of successive shafts mutually in line in transport direction or discs of successive shafts mutually staggered, but with rotary contours not projecting between rotary contours of discs of neighboring shafts.

In this example, the conveyors 1, 2 are further each provided with a motor-transmission unit 12 (FIG. 1) and transmission systems for driving the shaft assemblies 7. The transmission systems each include sprocket wheels 13 (not all sprocket wheels 13 are designated by reference numerals) rotationally fixed relative to the shaft assemblies 7, for transmitting driving forces exerted by the respective motor 12. The sprocket wheels 13 are engaged by a chain 14 which passes over the sprocket wheels 13, over divert wheels 15 (not all divert wheels 15 are designated by reference numerals) and over tensioning wheels 16. The tensioning wheels 16 are rotatably suspended from a tensioning structure which is adapted for resiliently exerting a tensioning force in a direction indicated by arrows 18.

In operation, material to be separated is fed along the feeding conveyor 3. From there, the material is deposited onto the upstream separating conveyor 1. The upstream separating conveyor 1 transports the material in conveying direction 8 through rotation of the discs 9 in conveying direction 8. Since the discs include radially projecting portions 11, the material on the conveyor 1 is simultaneously intermittently urged upwards and thereby agitated, which increases the likelihood that items sufficiently small and/or flexible to pass through open spaces in the conveyor 1 will eventually drop through the conveyor 1. Material that has not dropped through the conveyor 1 and reaches the downstream end of the conveyor 1 is dropped onto the downstream separating conveyor 2, where the same separating treatment is repeated, optionally at a different separation setting, so that a further fraction of the material, with different properties than the fraction that is first separated, is separated.

Material that has dropped through the conveyors 1, 2 is carried off along discharge conveyors 4, 5. Material that has also passed the downstream conveyor 2 without dropping through is dropped onto a third discharge conveyor 6 and carried off to another location. The mutual spacing of the discs 9 of each shaft assembly 7 in the longitudinal direction of that shaft assembly 7 is adjustable.

In this example, each of the separating conveyors 1, 2 is constituted by an upstream section 29 and a downstream section 30. The mutual spacings between the shafts 17 in the upstream sections 29 and between the shafts 17 in the downstream sections 30 are independently adjustable. The upstream and downstream sections 29, 30 of each of the separating conveyors 1, 2 are driven by separate chains 14, so the circumferential velocities of the shaft assemblies 7 in the upstream and downstream sections are controllable independently of each other.

In FIG. 1, the upstream sections of both conveyors 1, 2 are shown in a setting in which the chain 14 skips a divert wheel 15 as well. The spare divert wheels 15 allow mounting an additional shaft. As is best seen in FIGS. 5-8, the discs 9; 59; 109; 159 are each provided with an opening 24; 74; 124; 174 through which a shaft 17; 117; 167 carrying that disc 9; 59; 109; 159 extends. A releasable part 25; 75; 125; 175 (in these examples one of the disc halves) is displaceable when in released condition. When the releasable part 25 is in displaced condition, a radial passage for passing the shaft 17 radially into and out of the opening 24; 74; 124; 174 is obtained. This construction of the discs allows the discs 9; 59; 109; 159 to be mounted on and dismounted from the shafts 17; 117; 167 without dismounting the shafts 17; 117; 167. Thus, if damage to a disc 9; 59; 109; 159 or readjustment of the lateral spacing between the discs 9; 59; 109; 159 necessitates mounting or dismounting discs 9; 59; 109; 159, the discs 9; 59; 109; 159 can be dismounted from the shaft assembly 7 or mounted onto the shaft 17; 117; 167 without dismounting the shaft 17 from the separating conveyor apparatus. In particular, given the fixed width of the separating conveyors 1, 2, substantial adjustment of the mutual, lateral spacing between the discs 9 of a shaft assembly 7 will generally require the removal or addition of at least one disc 9; 59; 109; 159.

The discs 9; 59; 109; 159 of the separating conveyors shown can be manufactured particularly efficiently, because the disc body is formed by two mutually identical parts 25; 75; 125; 175. The parts 25; 75; 125; 175 are releasably clamped around the one of the shafts 17 carrying that disc 9; 59; 109; 159 by bolts 26 engaging nuts 27 in the opposite parts. The disc body can also be advantageously formed by more than two identical parts clamped around the shaft.

The discs 9; 59; 109; 159 have radial projections 11; 61; 111; 161 projecting further outward than radially recessed portions 28; 78; 128; 178 between the projections 11; 61; 111; 161. However, depending on the requirements and properties of the materials to be separated, other shapes may be more advantageous. The discs 9; 109; 159 are preferably made of elastomeric and/or polymeric material. However, as is illustrated in the example shown in FIG. 6, some or all of the discs 59 can be made of metal plate material, for instance if more peaked impacts and more local impacts on the material to be sorted are desired, for instance for breaking up or shaking off of particles of the materials. The discs 9; 59; 109; 159 each have a maximum width w in the longitudinal direction of the shaft 17; 127; 167.

Further details are first described with reference to the first example shown in FIGS. 1-5. The shaft 17 to which the discs 9 of a row of discs 9 are clamped has two strips 36 oriented in the longitudinal direction of said shaft 17. The strips 38 project radially (in a direction transverse to the longitudinal direction of the strips) from a circumferential surface of the shaft 17 and having a toothed surface 39. Teeth 40 of the toothed surface 39 project transversely to the axial direction of the shaft 17 and are arranged in a row with a pitch p in the longitudinal direction of the shaft 17. The openings 24 of the discs 9 each have recesses 35 closely fitting to the strips 36 and having a surface 41 (see FIG. 5) having teeth in engagement with the teeth 40 of the toothed surface 39 of the strip 36. The pitch p of the teeth 40 of the strip 36 is smaller than the maximum width w of each the discs 9 in the longitudinal direction of the shaft 17.

Because the teeth 40 of the toothed surface 39 of the strip 36 and the teeth 41 of the disc 9 are in engagement and the pitch p of the teeth 40 of the strip 36 is smaller than the maximum width w of the individual discs 9 in the longitudinal direction of the shaft 17, a fine adjustment of the axial position of the discs 9 is allowed, but also distinct predetermined mounting positions are provided, which facilitates mounting the discs 9 accurately with mutually identical axial spacings between all neighboring discs 9 on the shaft 17. The toothed surface 39 provided on a strip 36 projecting radially from the shaft 17 can be manufactured in an efficient way, because no shaping process has to be performed on the shaft 17 as a whole.

For a particularly fine adjustability, the pitch p of the teeth 40 of the strip 36 can be at least two times and more preferably at least five or at least eight times smaller than the maximum width w of each of the discs 9 in the longitudinal direction of the shaft 17. However, for allowing positioning neighboring discs 9 at mutually identical distances quickly and easily, it is preferred that the pitch p of the teeth 40 of the strip 36 is not more than 20 times and more preferably not more than 12 times smaller than the maximum width w of each of the discs 9 in the longitudinal direction of the shaft 17.

In particular if, as in the present example, two (or more) strips 36 are provided in positions evenly distributed around the circumference of the shaft 17, the predetermined positions defined by the interengaging teeth 40, 41 are also helpful for quickly mounting the discs 9 in orientations exactly perpendicularly to the shaft 17. It is however also possible to provide a shaft of which the positions of the strips with a toothed surface are not evenly distributed about the circumference or to provide a shaft with just one strip with a toothed surface.

The teeth 40 of the strips 36 are located on a surface facing away from the shaft 17 and the teeth 40 each have a top further away from the axial center line of the shaft 17 than a base of the respective tooth 40. Thus, a clamping force clamping the discs 9 to the shaft 17 also clamps the teeth 40 of the strip 36 and the tooth or teeth 41 of the discs 9, which are then mounted on a surface facing the shaft 17, against each other. Moreover, such strips 36 can be manufactured at low costs and mounted easily.

For particularly tight engagement of the teeth 40 of the strip 36 and the teeth 41 of the discs 9, the disc parts 25 are preferably urged towards each other by the clamping members 26, 27 in directions parallel to the direction in which the teeth 40 of the strip 36 project.

For accurate positioning of the discs 9 it is further advantageous if at least the teeth 40 of the strip or the teeth 41 of the discs 9 have flanks converging towards a furthest projecting top end of the respective tooth. The teeth then each center between two opposite teeth.

The discs may each have one tooth only, but for durability it is preferred that each of the discs 9 has a plurality of the teeth with a pitch p' in the longitudinal direction of the shaft 17 equal to or a whole multiple of the pitch p in the longitudinal direction of the shaft 17 of the row of teeth 40 of the strip 36.

Figure 7:
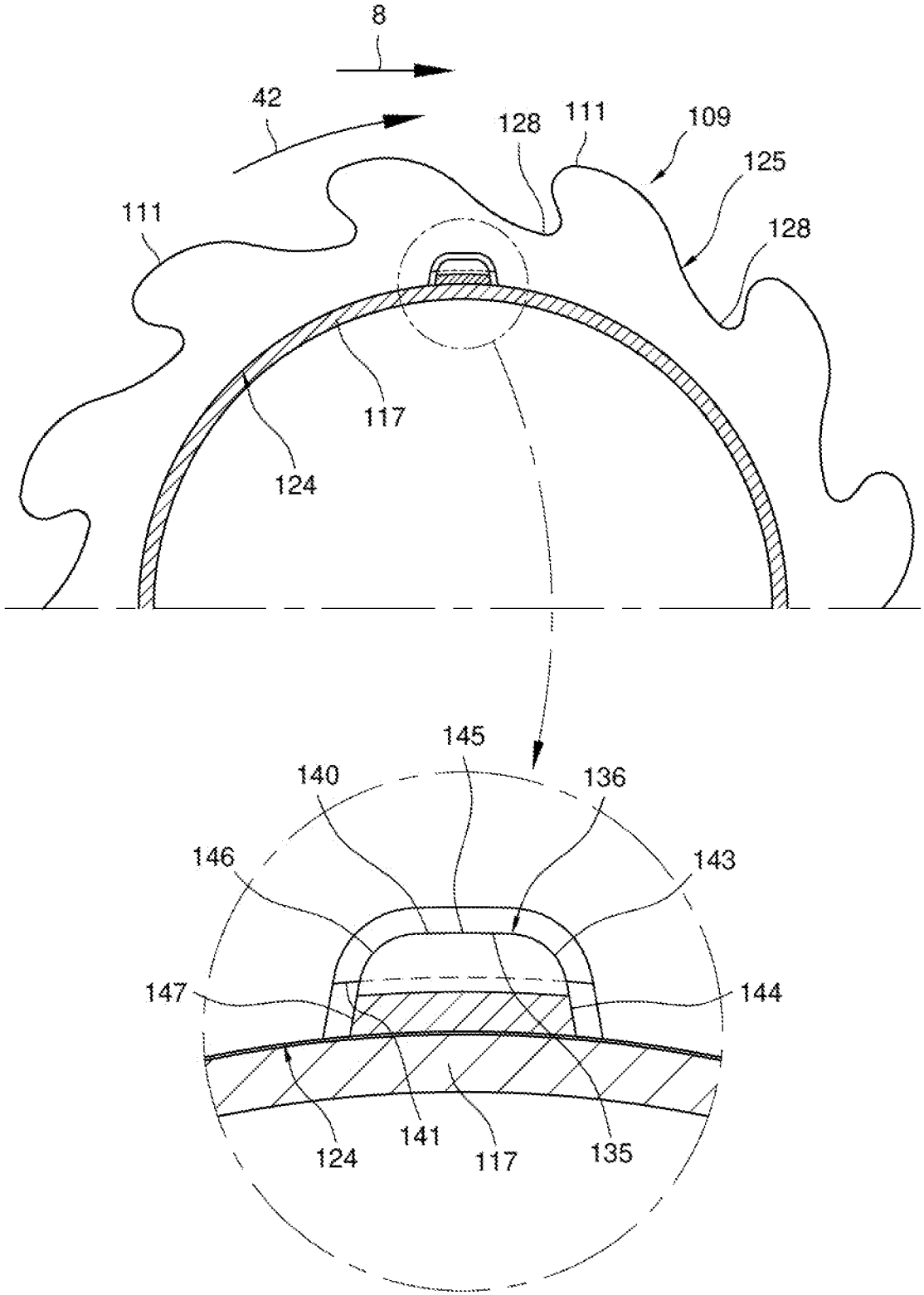
FIG. 7 is a cross-sectional view of a shaft assembly of a third example of a separating conveyor system according to the present invention.

In the example shown in FIG. 7, the shaft 117 is rotatable in a transport sense of rotation 42 with upwardly facing surface sections of the shaft 117 moving in the conveying direction 8. A transition 143 between a side 144 of the strip 136 leading in the transport sense of rotation 42 and a side 145 of the strip 136 facing away from the shaft 117 is rounded. This reduces any tendency of flexible flat and long fiber material to cling to the strip and wind up around the shaft 117, which winding-up influences the sorting result by reducing the size of free openings through which material can drop through the sorting conveyor and makes maintenance and cleaning of the apparatus cumbersome and time consuming. In this example, also the transition 146 between a side 147 of the strip 136 trailing in the transport sense of rotation 42 and the side 145 of the strip 136 facing away from the shaft 117 is rounded, so that there is no risk of mounting the strip or the shaft with a trailing side(s) of the strip(s) leading in the sense of rotation 42.

For effectively counteracting winding-up of materials, the side of the strip 136 leading in the transport sense of rotation 42 is preferably rounded over at least an outer 50%, and more preferably at least an outer 70%, of its radial size.

Figure 8:
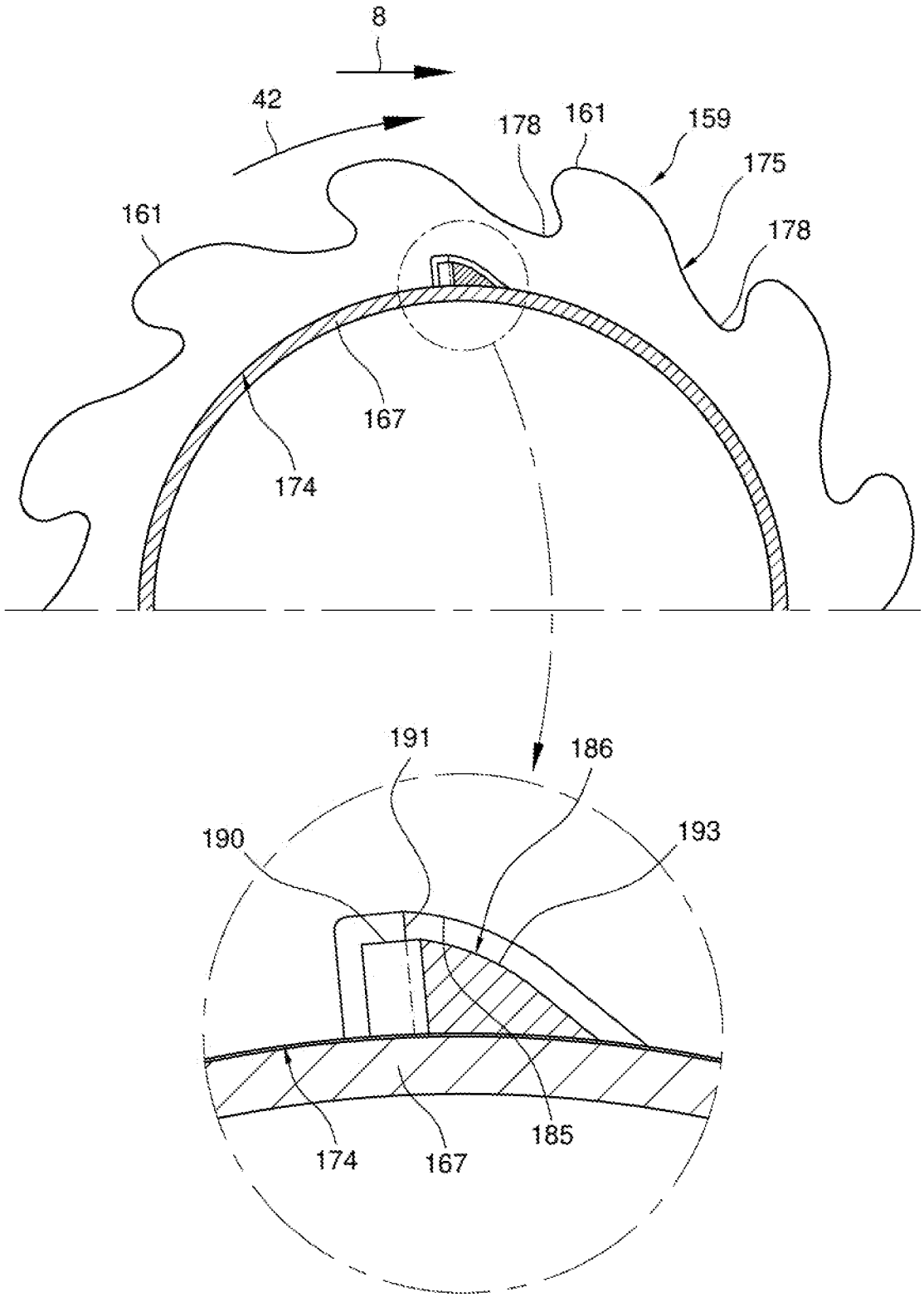
FIG. 8 is a cross-sectional view of a shaft assembly of a fourth example of a separating conveyor system according to the present invention.

As is illustrated by FIG. 8, instead of or in addition to being rounded, the transitions 193 can also be beveled. In this example, the entire leading side 194 is oblique relative to adjacent circumferential surface portions of the shaft 167, so that clinging of materials to the strip 186 is prevented particularly effectively.

In this example, the teeth 191 of the strip 186 are located on a surface facing in a direction opposite to the sense of rotation 42 and the teeth 190 of the disc 159 are located on a surface facing in the direction of the sense of rotation 42. Thus, clinging of materials to the teeth 190 of the strip 186 is avoided and the risk of damaging the teeth 191 by hitting materials being sorted is reduced. Such an arrangement is particularly useful when the material being sorted includes particularly hard and/or abrasive particles.

Several features have been described as part of the same or separate embodiments. However, it will be appreciated that the scope of the invention also includes embodiments having combinations of all or some of these features other than the specific combinations of features embodied in the examples.

The invention claimed is:

1. A separating screen conveyor for sorting a material composed of large numbers of loose items or particles, into a first fraction having a first distribution of a property of the particles or items and a second fraction having a second distribution of said property of the particles or items, said first distribution being different from said second distribution;

the conveyor screen comprising a row of shafts mutually spaced in a conveying direction, each of said shafts being rotatable about an axial center line thereof, extending transversely to said conveying direction, and carrying a row of radially projecting discs for intermittently urging material on the sorting conveyor upward and in the conveying direction, the discs of each of said rows being mutually spaced in longitudinal direction of the respective shaft;

wherein the discs of at least one of said rows are releasably clamped to the respective one of said shafts extending through openings in said discs, for allowing readjustment of the mutual spacing of said discs in said longitudinal direction of said shaft when in released condition, said discs each having a maximum width in said longitudinal direction of said shaft;

wherein the at least one shaft to which the discs of said at least one row are clamped has at least one strip oriented in said longitudinal direction of said shaft, projecting radially from a circumferential surface of the shaft and having a toothed surface, teeth of said toothed surface projecting transversely to the axial direction of the shaft and being arranged in a row with a pitch in said longitudinal direction of said shaft;

said openings of the discs each have at least one recess closely fitting to the at least one strip, respectively, and having at least one surface having at least one tooth in engagement with the teeth of said toothed surface of said strip; and said pitch of said teeth of said strip is smaller than said maximum width of each of said discs in said longitudinal direction of said shaft.

2. A separating screen conveyor according to claim 1, wherein said teeth of said strip are located on a surface facing away from said shaft, said teeth each having a top further away from the axial center line of the shaft than a base of the respective tooth.

3. A separating screen conveyor according to claim 1, wherein said at least one shaft is rotatable in a transport sense of rotation with upwardly facing surface sections of said shaft moving in the conveying direction and said teeth of said strip are located on a surface facing in a direction opposite to said sense of rotation.

4. A separating screen conveyor according to claim 1, wherein said at least one shaft is rotatable in a transport sense of rotation with upwardly facing surface sections of said shaft moving in the conveying direction and wherein at least a transition between a side of said strip leading in said transport sense of rotation and a side of said strip facing away from said shaft is beveled or rounded.

5. A separating screen conveyor according to claim 4, wherein said side of said strip leading in said transport sense of rotation is beveled or rounded over at least an outer 50% of its radial size.

6. A separating screen conveyor according to claim 1, wherein said discs comprise disc parts that are urged towards each other by clamping members, said clamping members operating in directions parallel to the direction in which said teeth of said strip project.

7. A separating screen conveyor according to claim 1, wherein at least said teeth of said strip or said at least one tooth of each of said discs has flanks converging towards a furthest projecting top end of the tooth.

8. A separating screen conveyor according to claim 1, wherein each of said discs has a plurality of said tooth with a pitch in said longitudinal direction of said shaft equal to or a whole multiple of said pitch in said longitudinal direction of said shaft of said row of teeth of said strip.

* * * * *